US008342637B2

(12) United States Patent
Nakazawa

(10) Patent No.: US 8,342,637 B2
(45) Date of Patent: Jan. 1, 2013

(54) SUCTION CAP DEVICE AND LIQUID JETTING APPARATUS PROVIDED WITH THE SAME

(75) Inventor: Fumio Nakazawa, Okazaki (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 396 days.

(21) Appl. No.: 12/625,877

(22) Filed: Nov. 25, 2009

(65) Prior Publication Data

US 2010/0128084 A1 May 27, 2010

(30) Foreign Application Priority Data

Nov. 26, 2008 (JP) ..... 2008-300368

(51) Int. Cl.
*B41J 2/165* (2006.01)

(52) U.S. Cl. ..... 347/30; 347/22; 347/29

(58) Field of Classification Search ..... None
See application file for complete search history.

(56) References Cited

U.S. PATENT DOCUMENTS

| | | | | |
|---|---|---|---|---|
| 6,616,265 | B2 | 9/2003 | Shindo et al. | |
| 6,702,422 | B1 * | 3/2004 | Suzuki et al. | 347/24 |
| 2004/0085429 | A1 | 5/2004 | Morikoshi | |
| 2007/0139464 | A1 | 6/2007 | Suzuki | |
| 2008/0002005 | A1 * | 1/2008 | Kobayashi et al. | 347/86 |
| 2008/0192083 | A1 | 8/2008 | Nishida | |

FOREIGN PATENT DOCUMENTS

| | | |
|---|---|---|
| CA | 2291925 | 8/2000 |
| EP | 1008454 | 6/2000 |
| JP | 10128988 | 5/1998 |
| JP | 11227225 | 8/1999 |
| JP | 2000-168108 | 6/2000 |
| JP | 2004-001485 | 1/2004 |
| JP | 2004-042444 | 2/2004 |
| JP | 2007-90807 | 4/2007 |
| JP | 2002-240325 | 9/2008 |
| JP | 2008-221836 | 9/2008 |

OTHER PUBLICATIONS

Machine translation of JP 11-268298 A.*
Machine translation of JP 2000-168108 A.*
Translation of JP 11-268298 A.*

* cited by examiner

*Primary Examiner* — Matthew Luu
*Assistant Examiner* — Justin Seo
(74) *Attorney, Agent, or Firm* — Frommer Lawrence & Haug LLP

(57) ABSTRACT

A suction cap device includes a cap member which is formed of an elastic member, which is formed to have a recessed portion, and which has a suction port formed in a bottom surface of the cap member to be located inside of the recessed portion; a suction mechanism which communicates with the suction port; and a cap protector which is accommodated in the recessed portion of the cap member, and which prevents the cap member from being deformed when a pressure inside the recessed portion is decreased. In a liquid flow passage formed in the cap protector, a lead-in port formed in the cap protector has a diameter which is greater than a diameter of a lead-out port formed in the cap protector. With this, it is possible to quickly discharge a liquid received in the cap member.

16 Claims, 10 Drawing Sheets

SUCTION CAP DEVICE AND LIQUID JETTING APPARATUS PROVIDED WITH THE SAME

CROSS REFERENCE TO RELATED APPLICATION

The present application claims priority from Japanese Patent Application No. 2008-300368, filed on Nov. 26, 2008, the disclosure of which is incorporated herein by reference in its entirety.

BACKGROUND OF THE INVENTION

1. Field of the Invention

The present invention relates to a suction cap device and a liquid jetting apparatus.

2. Description of the Related Art

Generally, a liquid jetting apparatus having liquid jetting head which jets a liquid is provided with a cap member which is made an elastic member and is capable of covering a liquid jetting surface, of the liquid jetting head, having nozzles formed therein. The cap member has a suction port communicating with a suction mechanism such as a suction pump, etc.; and during a purge processing for preventing any unsatisfactory discharge or jetting from the nozzles, the cap member covers the liquid jetting surface of the liquid jetting head and receives air bubble and/or a liquid having increased viscosity which is/are sucked from the inside of the nozzles by the suction pump. Then, the liquid jetting apparatus causes the cap member to be away from the liquid jetting surface, and drives the suction pump to discharge (discard) the liquid received in the cap member.

When the suction operation by the suction pump is carried out while covering the liquid jetting surface with the cap member, a tightly closed space (sealed space) defined by the inner wall surface of the cap member and the liquid jetting surface is depressurized. At this time, there is a fear that the cap member might be deformed due to the difference in pressure between the inside and outside of the sealed space, and that the deformation of the cap member might result in formation of a gap between the cap member and the liquid jetting surface. To address such a situation, a cap chip is conventionally known which is accommodated or arranged in the cap member and which restrain or regulate the deformation of the cap member. Since the cap chip needs to have rigidity sufficient for regulating or restraining the deformation of the cap member, the cap chip is disposed on the entire surface, of the cap member, on which the liquid is received, and the cap chip has a through hole for causing or guiding the liquid inside the cap member to flow to the side of the suction port. For example, Japanese Patent Application laid-open No. 2008-221836 (see FIG. 3) describes a cap member provided on an ink-jet recording apparatus having an ink-jet head, and accommodating a cap chip which has through holes of a same diameter and formed to penetrate through the cap chip in the thickness direction of the cap chip.

However, in the cap chip provided on the recording apparatus having the ink-jet head described in Japanese Patent Application laid-open No. 2008-221836, the through holes are formed to have a small diameter such that the liquid can flow easily through the through holes by the capillary action. However, since the diameter of the opening, of each of the through holes, on a surface the cap chip surface opposite to the side of the suction port (opposite-side surface) becomes also small, it is difficult for the ink to flow into the through holes. On the other hand, although it is possible to conceive a method for increasing the diameter of the through holes to thereby enlarge the diameter of the opening of the through holes on the opposite-side surface, this makes the diameter of the through holes be increased entirely in the thickness direction of the cap chip. Consequently, it is not possible to secure the rigidity sufficiently enough to restrict or regulate the deformation of the cap member and, at the same time, the capillary force acting on the ink flowing through the through holes is reduced.

SUMMARY OF THE INVENTION

In view of the above, an object of the present invention is to provide a suction cap device which is capable of quickly discharging the liquid received in the cap member while restraining the deformation of the cap member, and to provide a liquid jetting apparatus provided with the suction cap device.

According to a first aspect of the present invention, there is provided a suction cap device capable of covering a liquid jetting surface, of a liquid jetting head, having a jetting port which is formed in the liquid jetting surface and through which a liquid is jetted, the suction cap device including: a cap member which is formed of an elastic member, which is configured to cover the liquid jetting surface, which is formed to have a recessed portion, and which has a suction port formed in a bottom surface of the cap member to be located inside the recessed portion; a suction mechanism which communicates with the suction port; and a cap protector which is accommodated in the recessed portion of the cap member, and which prevents, under a condition that the suction mechanism carries out a suction in a state that the liquid jetting surface is covered by the cap member, the cap member from being deformed due to decrease in pressure inside the recessed portion, the cap protector including a body and a liquid flow passage which has a lead-in port formed to penetrate through the body and open on a first surface, of the body, on a side opposite to the suction port and a lead-out port formed to penetrate through the body and open on a second surface, of the body, facing the suction port, and which causes the liquid inside the cap member to flow; wherein in the liquid flow passage, a diameter of the lead-in port is greater than a diameter of the lead-out port.

According to the first aspect of the present invention, by forming the lead-in port to have a large diameter, it is possible to easily cause the liquid on the surface of the body of the cap protector to flow into the liquid flow passage. Further, by forming the lead-out port to have a small diameter, it is possible to secure the rigidity sufficiently enough for suppressing the deformation of the cap member, while increasing the capillary force acting on the liquid flowing through the liquid flow passage. Thus, it is possible to actively (positively) discharge the liquid on the surface (first surface) of the body of the cap protector to the back surface (second surface) through the liquid flow passage, thereby quickly sending (forwarding) the liquid to the suction port. With this, it is possible to quickly discharge the liquid received in the cap member, while suppressing the deformation of the cap member.

According to a second aspect of the present invention, there is provided a liquid jetting apparatus which jets a liquid onto an object, the liquid jetting apparatus including: a liquid jetting head having a liquid jetting surface having a jetting port which is formed in the liquid jetting surface and through which the liquid is jetted; the suction cap device according to the first aspect of the present invention which is configured to cover the liquid jetting surface; a liquid tank which supplies the liquid to the liquid jetting head; and a transport mechanism which transports the object toward the liquid jetting head.

In the liquid jetting apparatus according to the second aspect of the present invention, the liquid in the cap member is actively sent to the suction port of the cap member through the liquid flow passage provided in the cap protector, while restraining (suppressing) the deformation of the cap member. By doing so, the liquid received in the cap member can be discharged quickly.

DESCRIPTION OF THE PREFERRED EMBODIMENT

Next, a preferred embodiment of the present invention will be described. In the embodiment, the present invention is applied to a suction cap device provided in a printer which records (prints) a desired character, image, etc. on a recording paper by jetting an ink from an ink-jet head onto the recording paper.

Figure 1:
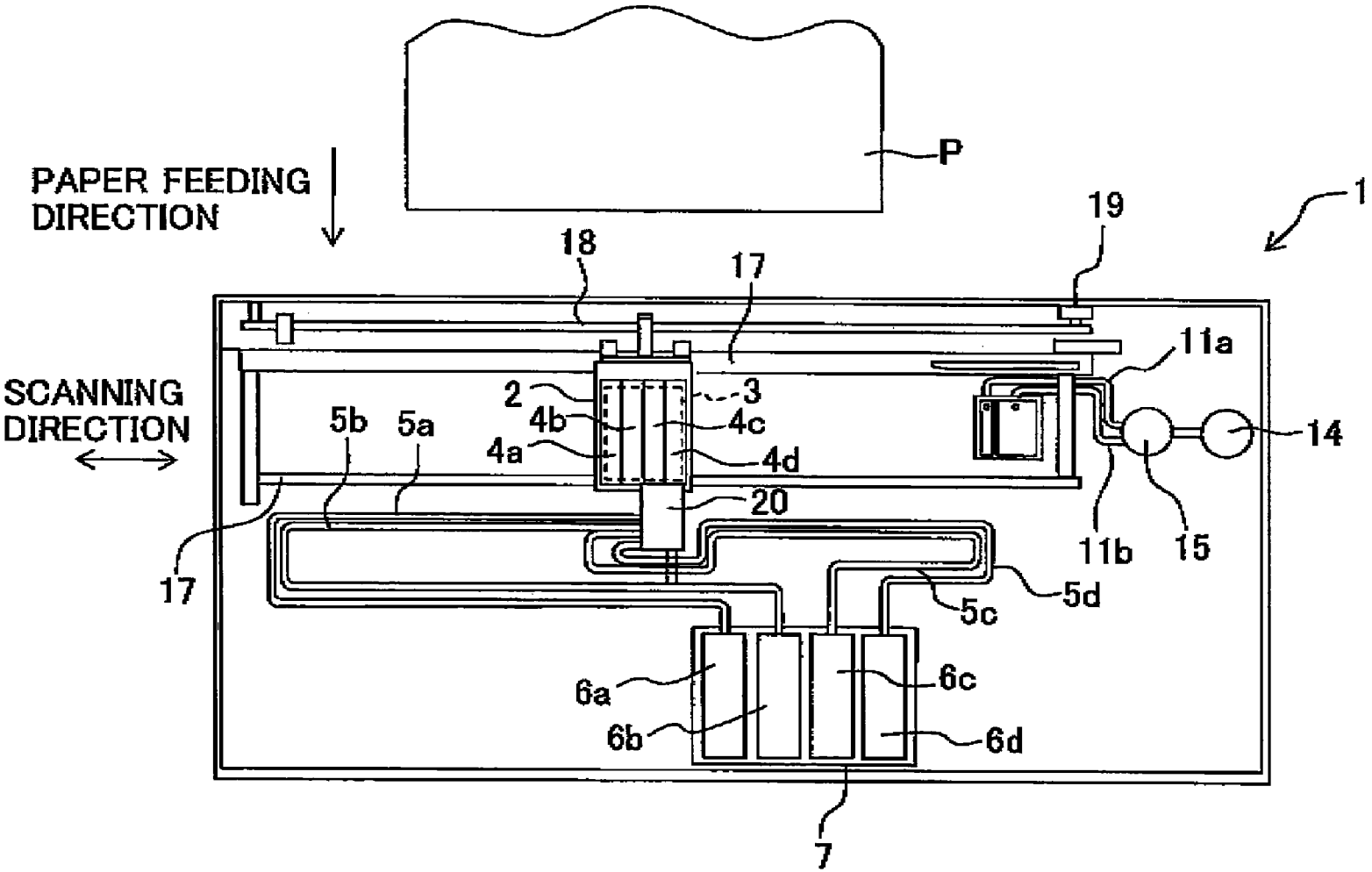
FIG. 1 is a plan view showing a schematic construction of a printer as an example of the liquid jetting apparatus according to an embodiment of the present invention.

As shown in FIG. 1, a printer 1 includes a carriage 2 which is constructed to be movable reciprocatingly in a direction, an ink-jet head (liquid jetting head) 3 which is provided on the carriage 2, sub ink tanks 4*a* to 4*d*, ink cartridges 6*a* to 6*d* which store an ink, a suction cap device 13 which is capable of covering an ink jetting surface 38 (see FIG. 2) of the ink-jet head 3, and the like.

The carriage 2 is constructed to be movable reciprocating manner in a scanning direction (right-left direction in FIG. 1) along two guide axes 17 extending parallel to the scanning direction. Further, an endless belt 18 is connected to the carriage 2 such that the carriage 2 is moved in the scanning direction accompanied by the traveling of the endless belt 18 when the endless belt 18 is driven and made to travel by a carriage drive motor 19.

On the carriage 2, the ink-jet head 3 and the four sub ink tanks 4*a* to 4*d* are provided. The ink-jet head 3 jets inks onto a recording paper P, which is fed or transported in a paper feeding direction (toward a lower portion of FIG. 1) by a paper transport mechanism (not shown), from a nozzle (a jetting port) 40 (see FIG. 2) formed on the ink jetting surface 38 (the surface located at the back side of the sheet surface of FIG. 1), while reciprocating in the scanning direction together with the carriage 2. With this, a desired character, image, etc. is/are recorded on the recording paper P.

The four sub ink tanks 4*a* to 4*d* are arranged to be aligned in the scanning direction; and a tube joint 20 is provided integrally with the sub ink tanks 4*a* to 4*d*. Further, the four sub ink tanks 4*a* to 4*d* are connected to the four ink cartridges 6*a* to 6*d* via flexible tubes 5*a* to 5*d*, respectively, which are connected to the tube joint 20. Four color inks of black, yellow, cyan and magenta inks are stored in the four ink cartridges 6*a* to 6*d*, respectively; and the ink cartridges 6*a* to 6*d* are detachably attached to a holder 7. The four color inks stored in the four ink cartridges 6*a* to 6*d* flow through the tubes 5*a* to 5*d* into the sub ink tanks 4*a* to 4*d*, at which the four color inks are temporarily stored therein respectively, and then the four color inks are supplied to the ink-jet head 3.

Figure 2:
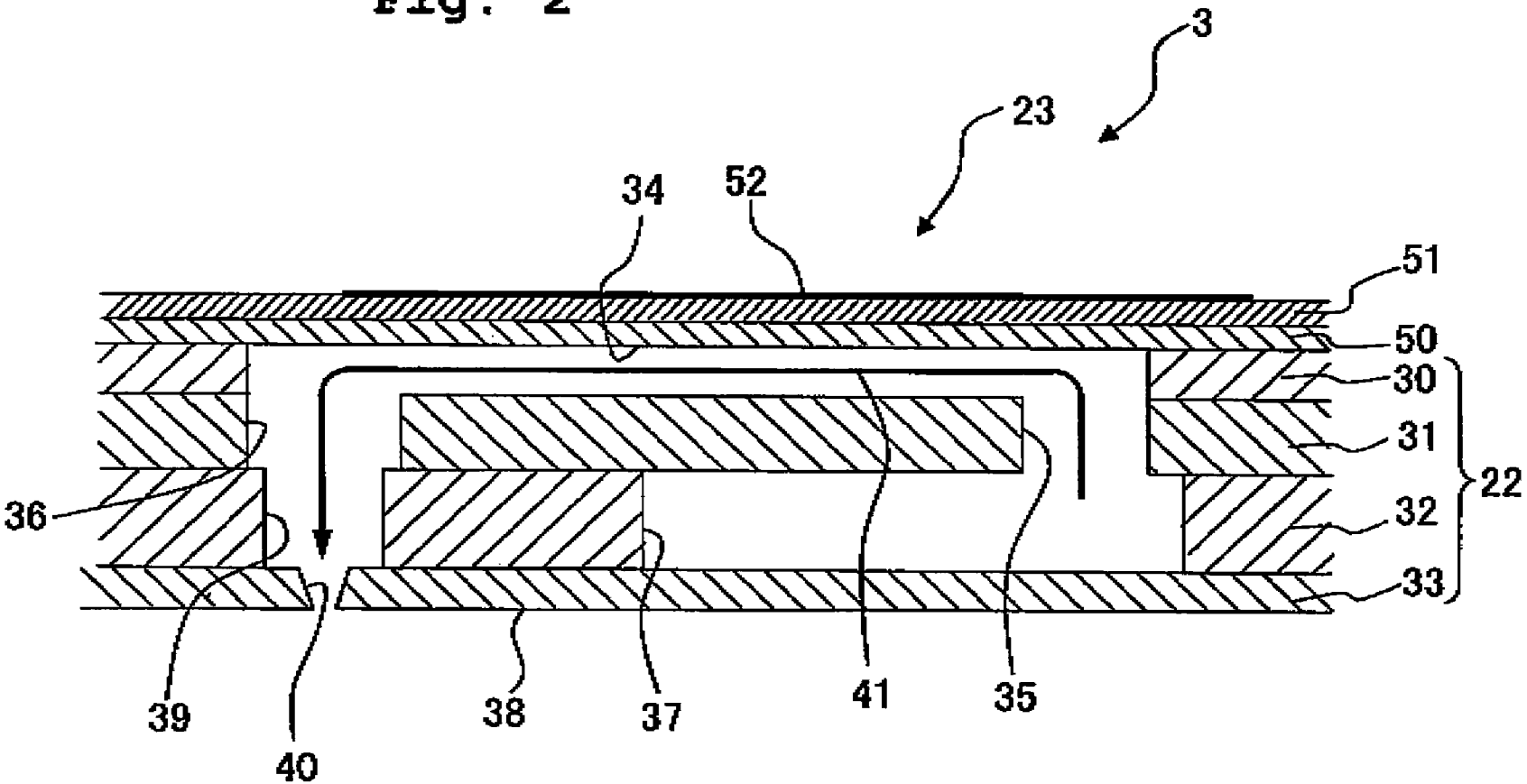
FIG. 2 is a vertical cross section of a part of an ink-jet head.

Next, the inkjet head 3 will be explained. As shown in FIG. 2, the ink-jet head 3 has a flow passage unit 22 in which an individual ink flow passage 41 including a nozzle 40 and a pressure chamber 34 is formed, and a piezoelectric actuator 23 which applies pressure on the ink in the pressure chamber 34 so as to cause the ink to be jetted from the nozzle 40 of the flow passage unit 22.

The flow passage unit 22 includes a cavity plate 30, a base plate 31 and a manifold plate 32 each of which is formed of a metallic material such as stainless steels, etc.; and a nozzle plate 33 which is formed of an insulating material (for example, a high polymer synthetic-resin material such as polyimide, etc.). These four plates 30 to 33 are joined together in a stacked state.

A plurality of pieces of the pressure chamber 34 are formed in the cavity plate 30. Further, the pressure chambers 34 are aligned in a direction perpendicular to the sheet surface of FIG. 2. Communication holes 35 and 36 which communicate with each of the pressure chambers 34 are formed in the base plate 31. Further, a manifold 37 which communicates with each of the pressure chambers 34 via the communication hole 35, and a communication hole 39 which is connected to the communication hole 36 is formed in the manifold plate 32. Furthermore, a plurality of pieces of the nozzle 40 are formed in the nozzle plate 33 such that the nozzles 40 are aligned in the direction perpendicular to the sheet surface of FIG. 2, corresponding to the pressure chambers 34 respectively. Moreover, a plurality of pieces of the individual ink flow passage 41, each of which is from the manifold 37 to one of the nozzles 40 via one of the pressure chambers 34, are formed in the flow passage unit 22.

The piezoelectric actuator 23 includes a metallic vibration plate 50 which is joined to the upper surface of the flow passage unit 22 so as to cover the plurality of pressure chambers 34, a piezoelectric layer 51 which is arranged on the vibration plate 50, and a plurality of individual electrodes 52 which are formed on the piezoelectric layer 51.

The metallic vibration plate 50 is constantly maintained at the ground potential by a head driver (not shown). Further, the piezoelectric layer 51 is made of a piezoelectric material mainly composed of lead zirconate titanate (PZT), which is a solid solution of lead titanate and lead zirconate, and which is a ferroelectric substance, and the piezoelectric layer 51 is arranged on the vibration plate 50 so as to cover the pressure chambers 34. Each of the individual electrodes 52 is arranged on the upper surface of the piezoelectric layer 51, at an area (region) facing the central portion of one of the pressure chambers 34. Further, either the ground potential or a predetermined drive potential different from the ground potential is applied to these individual electrodes 52 by the head driver (not shown).

In the following, an explanation will be given about the function of the piezoelectric actuator 23 at the time of ink jetting (ink discharge). In a case that the ink is made to be jetted from a certain nozzle 40 among the plurality of the nozzles 40, the head drive applies a drive potential to an individual electrode 52 among the plurality of individual electrodes 52 which corresponds to one of the pressure chambers 34 communicating with the certain nozzle 40. As a result, a potential difference is generated between the individual electrode 52 to which the drive potential is applied and the vibration plate 50 maintained at the ground potential, thereby generating an electric field which is parallel to the thickness direction in the piezoelectric layer 51, at a portion of the piezoelectric layer 51 sandwiched between the individual electrode 52 and the vibration plate 50. Since the direction of the electric field is coincide with the polarization direction of the piezoelectric layer 51, the piezoelectric layer 51 polarized in the thickness direction is contracted in a planar direction of the piezoelectric layer 51 which is perpendicular to the direction of the electric field (piezoelectric lateral effect). With this, a portion of the vibration plate 50 facing the pressure chamber 34 deforms to form projection toward the pressure chamber 34 (unimorph deformation). At this time, due to a decrease in the volume of the pressure chamber 34, a pressure of the ink inside the pressure chamber 34 increases, thereby causing the ink to be jetted from the nozzle 40 communicating with the pressure chamber 34.

Next, the suction cap device 13 will be explained. The suction cap device 13 is constructed to cover the ink jetting surface 38 when the ink jetting surface is to be protected, and/or when a purge processing (to be described later on) is to be performed.

As shown in FIG. 1, in a moving (traveling) range of the carriage 2 with respect to the scanning direction, the suction cap device 13 is arranged at an area (area on the right side in FIG. 1) located at a position outside of an printing area facing the recording paper P (hereinafter referred to as "maintenance position"); and the suction cap device 13 faces the ink jetting surface 38 of the ink-jet head 3 when the carriage 2 is moved to the maintenance position.

Figure 3:
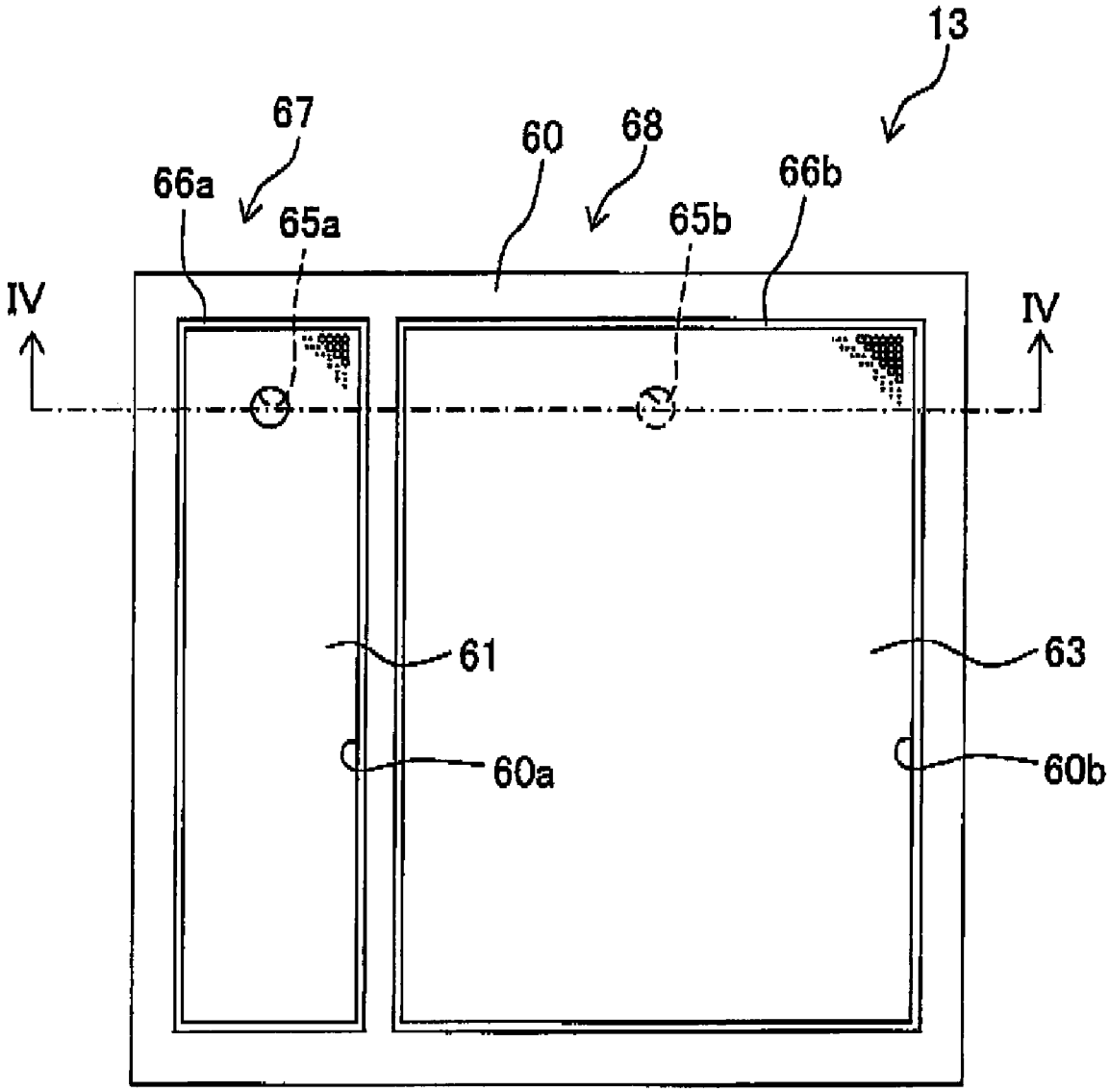
FIG. 3 is a plan view of a cap device.
Figure 4:
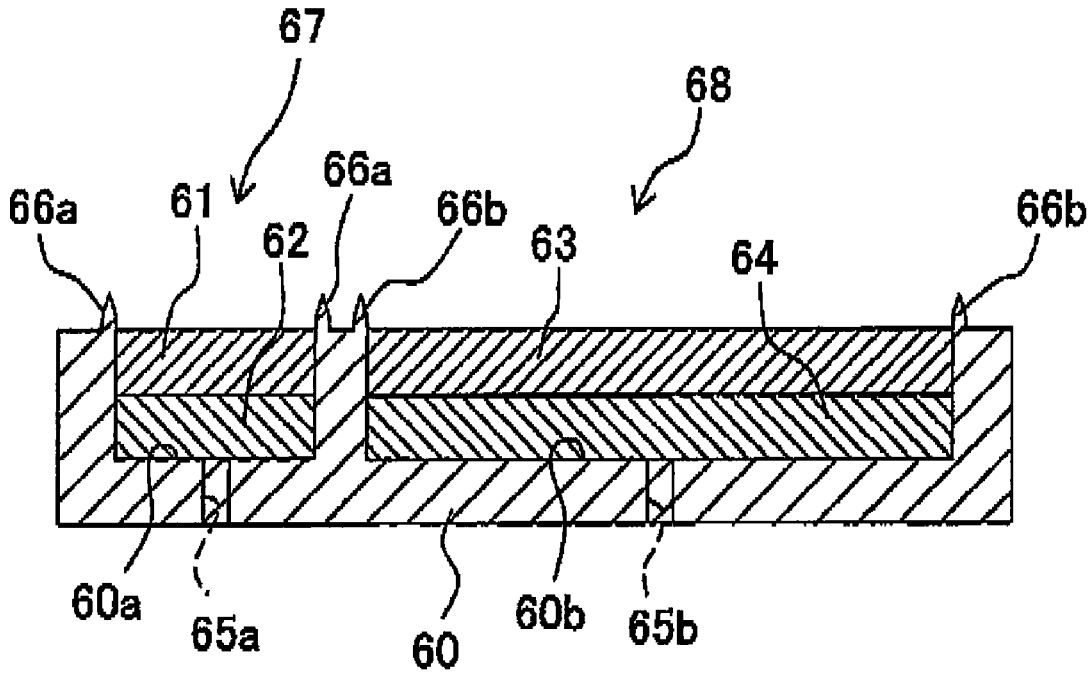
FIG. 4 is a cross-sectional view taken along a line IV-IV of FIG. 3.

As shown in FIGS. 3 and 4, the suction cap device 13 includes a cap 60 having two recessed portions 60*a* and 60*b*, a cap protector (cap chip) 67 which is stacked on and accommodated in the recessed portion 60; a cap protector (cap chip) 68 which is stacked on and accommodated in the recessed portion 60*b*, and a suction pump 14 (suction mechanism).

The cap 60 is a rectangular flat plate and is made of an elastic member such as rubber, etc. Further, in the cap 60, the rectangular recessed portion 60*a* is formed to open in the up direction at an area of the cap 60 overlapping, in a plan view, with nozzles 40 among the plurality of nozzles 40 which jets the black ink when the ink-jet head 3 is moved to the maintenance position; and the rectangular recessed portion 60*b* is formed to open in the up direction at an area of the cap 60 overlapping, in a plan view, with nozzles 40 which jet the three color inks (for example, cyan, magenta and yellow inks) when the ink-jet head 3 is moved to the maintenance position. A suction port 65*a* is formed on the bottom of the recessed portion 60*a*; and a suction port 65*b* is formed on the bottom of the recessed portion 60*b*. The suction ports 65*a* and 65*b* formed in the recessed portions 60*a* and 60*b*, respectively, of the cap 60 are connected to the suction pump 14 via two tubes 11*a* and 11*b* with a switching unit 15 intervening therebetween (see FIG. 1).

On the surface of the cap 60, lips 66*a* and 66*b* which are made of an elastic member such as rubber, etc. are formed to project from the surface of the cap 60 such that the lips 66*a* and 66*b* surround the recessed portions 60*a* and 60*b* respectively. That is, the cap 60 is formed integrally with the lips 66*a* and 66*b*. When the ink-jet head 3 is moved to the maintenance position, the cap 60 is driven by an elevating motor (not shown) upward (in a direction lifting upward away from the sheet surface of FIG. 1), thereby causing the tip portions (end portions) of the lips 66*a* and 66*b* to be brought into contact with the ink jetting surface 38. Thus, two sealed spaces (tightly closed spaces) are defined by the ink jetting surface 38, and the lips 66*a*, 66*b* and the recessed portions 60*a*, 60*b* of the cap 60.

Here, although the cap 60 and the lips 66*a*, 66*b* are integrally formed of an elastic member, the present invention is not limited to this construction. For example, it is allowable that the cap is formed of a resin plate member and only the lips are formed of an elastic member; and that the cap and the lips are joined together with an adhesives, etc. In the embodiment, however, since the cap 60 and the lips 66*a* and 66*b* are integrally formed without any joining portion therebetween, it is easier to maintain the sealed spaces than in a case that the cap and the lips are formed as separate members.

By bringing the ink jetting surface 38 in contact with the end portions of the lips 66*a* and 66*b* formed on the cap 60 to thereby define the sealed spaces in this manner, the ink jetting surface 38 is covered by the cap 60, thereby protecting the nozzles 40 formed on the ink jetting surface 38.

In addition, in the state that the ink jetting surface 38 is brought in contact with the end portions of the lips 66*a* and 66*b* formed on the cap 60, the purge processing (purge operation) is performed by activating the suction pump 14 to suck and discharge (discard) the ink(s) from the nozzles 40. At this time, by using the switching unit 15 to cause the suction pump 14 to be communicated switchingly between the suction ports 65*a* and 65*b*, it is possible to selectively perform the ink suction by selecting either through the nozzles 40 jetting black ink or the nozzles 40 jetting the color inks.

With this, it is possible to recover the ink-jetting performance of the ink-jet head 3 by discharging, from the nozzles 40, the ink or inks dried and thus having increased viscosity in the nozzles 40; or by discharging, together with the ink(s), from the nozzles 40, air bubbles entered and mixed in the ink flow passages of the ink-jet head 3 or entered and mixed in the sub ink tanks 4 located upstream of the ink flow passage.

Then, the operation of the suction pump 14 is stopped to stop the ink suction from the nozzles 40, the cap 60 is separated and away from the ink jetting surface 38 in the state that the inks are received in the recessed portions 60*a* and 60*b*. In a state that the sealed spaces are opened in this manner, the ink(s) sucked from the nozzles 40 in the purge processing and received in the recessed portions 60*a* and 60*b* of the cap 60 are discharged to a discharge tank (not shown) from the suction ports 65*a* and 65*b* by activating the suction pump 14 again (so-called empty suction operation).

Due to the suction by the suction pump 14 during the purge processing, the air pressure inside the sealed spaces are decreased (depressurized), thereby generating difference in air pressure between the inside and outside of the sealed spaces. The cap 60 is formed of an elastic member and thus is easily deformed; therefore, if the difference in air pressure becomes too great, the cap 60 is deformed into a horizontal C-shaped shape (incurvate shape) toward the inner side of the cap 60, thereby causing the lips 66*a* and 66*b* to be separated from the ink jetting surface 38. As a result, it is not possible to perform the ink suction from the nozzles 40, and/or this causes the ink received in each of the recessed portions 60*a* and 60*b* leak out in some cases.

In view of this, the cap protector 67 made of synthetic resin, etc. is accommodated in the recessed portion 60*a* so as to restrain the cap 60 from being deformed. Further, the cap protector 68 made of synthetic resin, etc. is accommodated in the recessed portion 60*b* for the same purpose. The cap protector 67 is formed by stacking two plate-shaped bodies (chip bodies) 61 and 62 each of which has a surface area similar to that of the recessed portion 60*a*. The cap protector 68 is formed by stacking two plate-shaped bodies 63 and 64 each of which has a surface area similar to that of the recessed portion 60*b*.

A plurality of through holes 71 (see FIG. 5) are formed in each of the body 61 accommodated as the upper layer in the recessed portion 60*a* and the body 63 accommodated as the upper layer in the recessed portion 60*b*, to penetrate through the thickness direction thereof. Further, a plurality of through holes 72 (see FIG. 5) is formed in each of the body 62 accommodated as the lower layer in the recessed portion 60*a* and the body 64 accommodated as the lower layer in the recessed portion 60*b*, to penetrate through the thickness direction thereof. The through holes 71 are communicated with the through holes 72, and thus the through holes 71 and 72 form ink flow passages for the ink(s) to flow therethrough. A diameter of the through holes 71 and a diameter of the through holes 72 formed in the cap protector 67 may be same as those formed in the cap protector 68, respectively. Alternatively, the diameter of the through holes 71 and the diameter of the through holes 72 formed in the cap protector 67 may be different from those formed in the cap protector 68, respectively. Still alternatively, overlapping areas between the through holes 71 and 72 of the cap protector 67 may be same as, or may be different from overlapping areas between the through holes 71 and 72 of the cap protector 68. The diameter of the through holes 71, 72, and/or the overlapping areas between the through holes 71 and 72 may be determined based on the viscosity of the ink to be sucked through the through holes. In other words, a flow conductance of the ink flow passage formed in cap protector 67 may be same as, or may be different form a flow conductance of the ink flow passage formed in cap protector 68. For example, when the cap protectors 67, 68 are used for a head jetting black pigment ink and a color head jetting color dye ink, respectively, and when a viscosity of the black pigment ink is greater than that of the color dye ink, the overlapping areas between the through holes 71 and 72 of the cap protector 67 may be greater than those of the cap protector 68 such that the flow conductance of ink flow passage in the cap protector 67 is greater than the flow conductance of ink flow passage in the cap protector 68.

Next, the positional relationship between the through holes formed in the bodies 61 to 64 will be explained. Note that in the embodiment, the explanation will be given about the positional relationship between the through holes 71 formed in the body 61 and through holes 72 formed in the body 62; and that the positional relationship between the through holes 71 formed in the body 63 and through holes 72 formed in the body 64 be omitted since the positional relationship therebetween is similar to that between the through holes 71 and 72 formed in the bodies 61 and 62, respectively.

Figure 5:
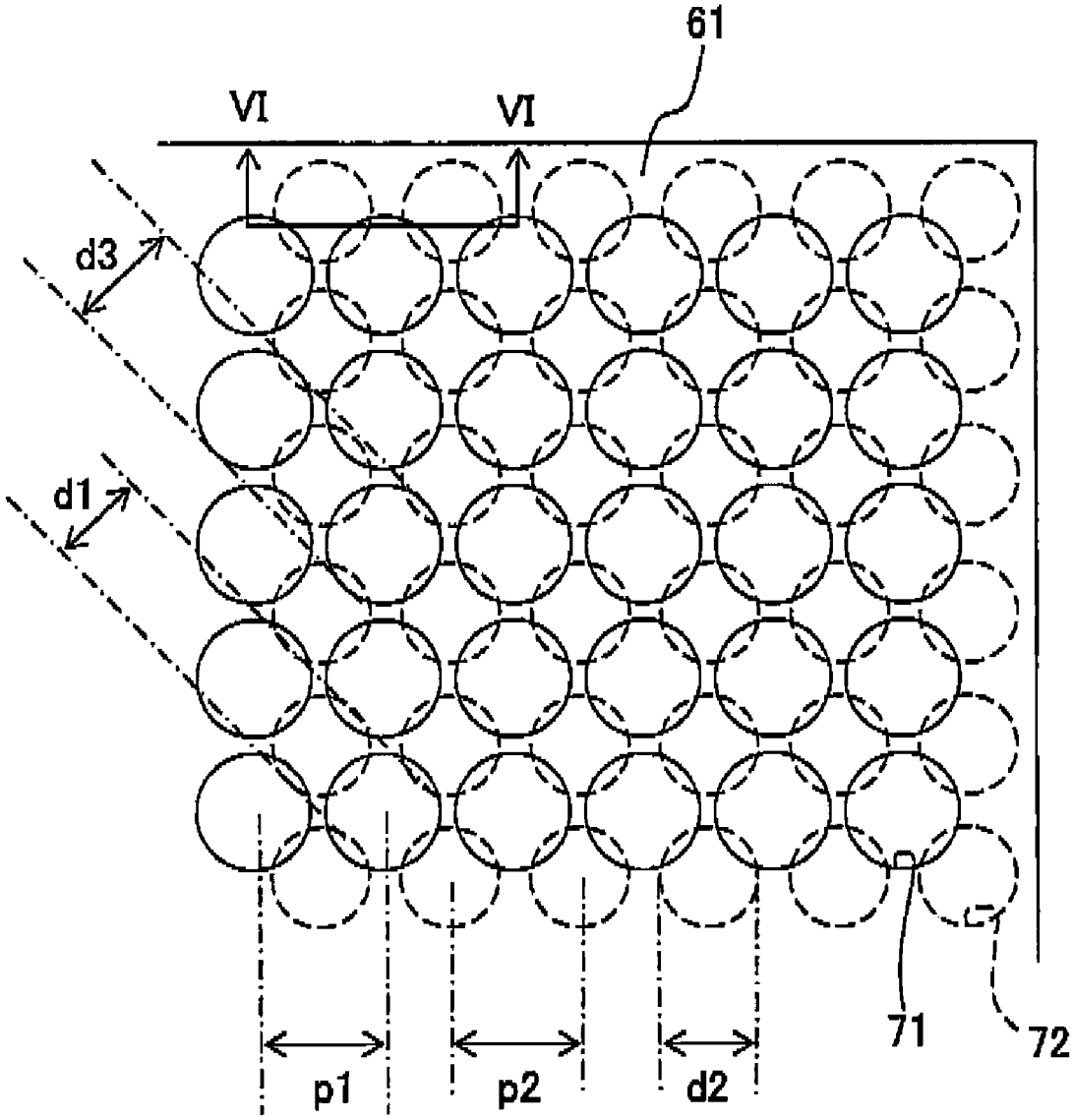
FIG. 5 is a partial enlarged view of a surface of a cap protector.
Figure 6:
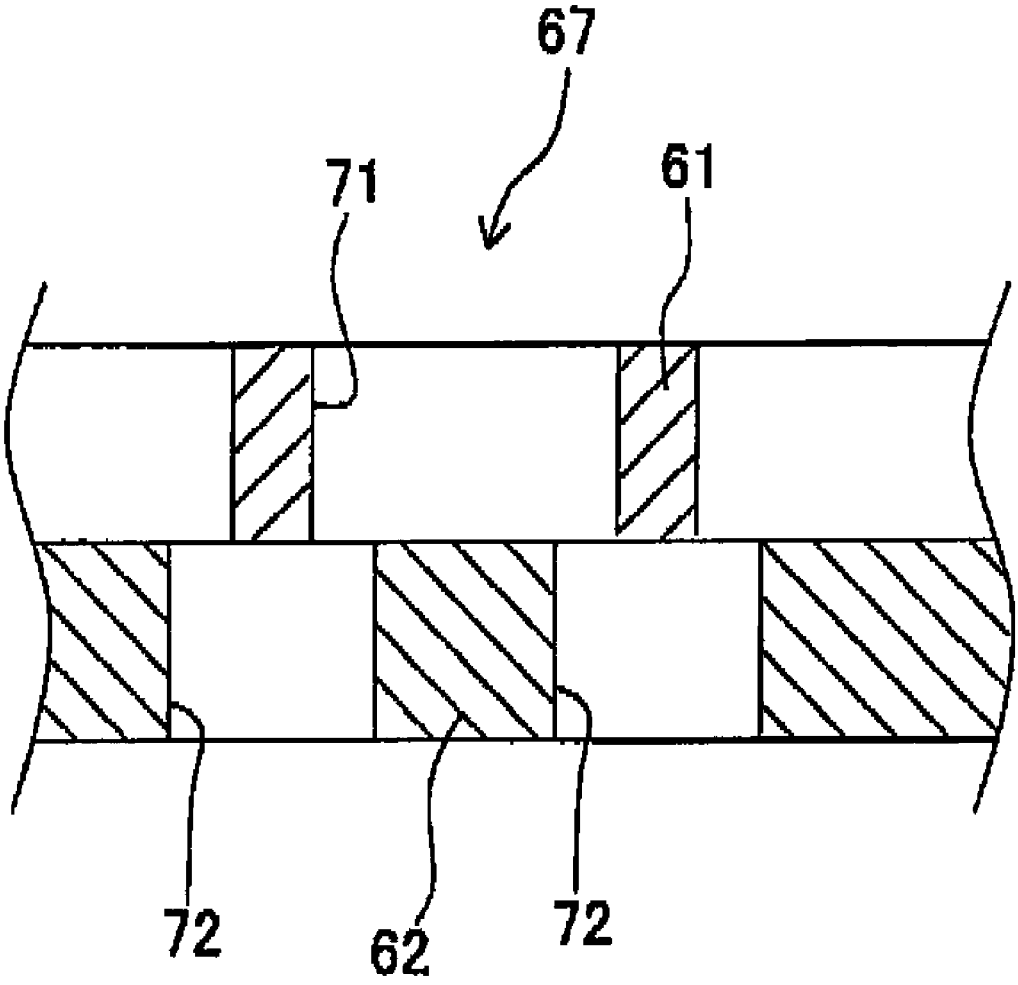
FIG. 6 is a cross-sectional view taken along the line VI-VI of FIG. 5.

As shown in FIGS. 5 and 6, the though holes 71 formed in the body 61 are arranged to be equally spaced apart (with a same spacing distance) and to be parallel to the two sides perpendicular to each other in the plane direction of the body 61. The though holes 72 formed in the body 62 have a diameter smaller than that of the through holes 71, and are arranged to be equally spaced apart (with a same spacing distance) and to be parallel to the two sides perpendicular to each other in the plane direction of the body 62.

Further, the through holes 72 are arranged such that four pieces of the through holes 72 are arranged, as seen in a plane view, to be equally spaced apart along the circumference direction of one piece of the through holes 71; and regarding the four through holes 72, an area (overlapping area) overlapping with the through hole 71 is same among the four through holes 72 in a plane view. Namely, one through hole 71 is communicated with four through holes 72. Further, each of the through holes 71 is formed in the body 61 such that the opening of the through hole 71 on a surface, of the body 61, facing the ink jetting surface 38 has a diameter which is greater than a diameter of the opening of through hole 72 on the back surface, of the body 62, facing the suction port 65*a*.

The through holes 71 are formed in the body 61 such that each of the through holes 71 is communicated with at least one of the through holes 72, even if the through holes 71 are positionally deviated or shifted in the planar direction perpendicular to the stacking direction when the bodies 61 and 62 are stacked.

As an example, as shown in FIG. 5, reference sign "p1" represents an arrangement spacing distance (interval) between two adjacent through holes 71 formed in the body 61, and reference sign "p2" represents an arrangement spacing distance between two adjacent through holes 72 formed in the body 62. Further, in a plan view, reference sign "d1" represents a diameter of the through hole 71 when the through hole is brought in contact with the through hole 72 at one point, reference sign "d2" represents a diameter of the through hole 72, and reference sign "d3" represents a diameter of the through hole 71 when the through hole 71 intersects with the through hole 72 at two points. In this case, $p1=p2$, and $d2$ is a constant.

Accordingly, the condition for the through holes 71 to overlap with the through holes 72 (namely, to be communicated with the through holes 72) in a plane view is: $d1+d2>\sqrt{2}\times p2$; therefore, $d1>\sqrt{2}\times p2-d2$. Further, the condition for two adjacent through holes 71 do not to overlap with each other is: $d3<p1$. Therefore, if "d" represents the diameter of the through holes 71 and a condition of $\sqrt{2}\times p1-d2<d<p1$ is met, then each of the through holes 71 is communicated with at least one of the through holes 72 even if the through holes 71 are positionally deviated or shifted in the planar direction perpendicular to the stacking direction when the bodies 61 and 62 are stacked.

Figure 7:
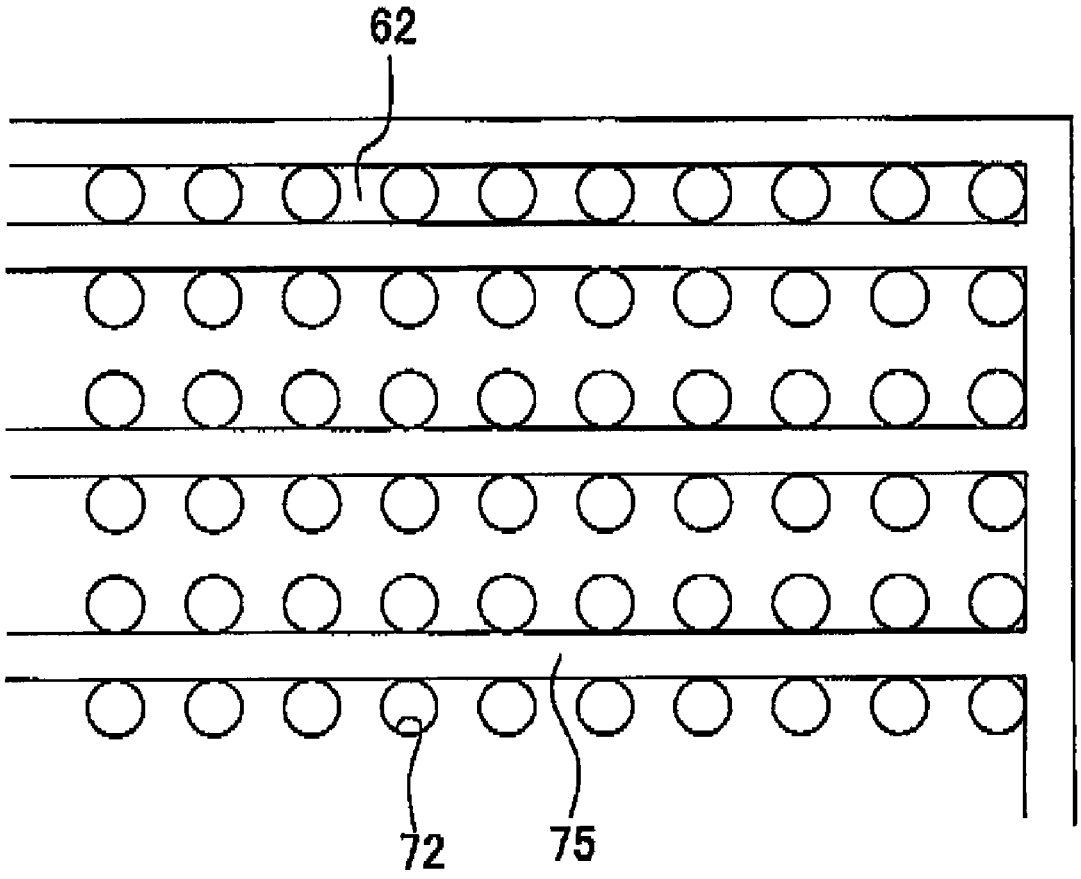
FIG. 7 is a partial enlarged view of the back surface of the cap protector.

As shown in FIG. 7, a groove 75 communicating with a plurality of pieces of the through holes 72 is formed on the back surface of the body 62 (the surface facing the suction port 65*a*), along an edge of the body 62. Note that a plurality of pieces of the groove 75 are formed to extend in one direction.

Here, an explanation will be given about a discharging process performed with the empty suction operation for discharging the black ink which is jetted (discharged) from the nozzles 40 in the purge processing and is received in the recessed portion 60*a* of the cap 60. The suction pump 14 is activated so that the black ink jetted from the nozzles 40 in the purge processing and received on the surface of the body 61 is made to flow into the through holes 71 formed in the body 61. At this time, since the diameter of the through holes 71 is greater than that of the through holes 72, the black ink easily flows into the through holes 71. After that, the black ink flowed into the through holes 71 flows further into the through holes 72 communicating with the through holes 71. Since the diameter of the through holes 72 is smaller than that of the through holes 71, the capillary force acting on the ink inside the through holes 72 is greater than the capillary force acting on the ink inside the through holes 71, thereby actively causing the ink to be flowed toward the back surface of the body 62.

The ink flowed out of the through holes 72 flows (travels) via the groove 75, and then is discharged from the suction port 65*a* and into a discharge tank (not shown). Thus, it is possible to quickly discharge the ink received in the recessed portion 60*a* of the cap 60. With respect to the color inks jetted from the nozzles 40 in the purge processing, it is also possible to quickly discharge the color inks in the same manner as the black ink described above.

In addition, since the diameter of the through holes 72 formed in the body 62 is smaller than the diameter of the through holes 71 formed in the body 61, the body 62 has the rigidity greater than the rigidity of the body 61. Further, the cap protector 67 is formed by stacking the two bodies 61 and 62, and the cap protector is accommodated in the recessed portion 60*a*, and the cap protector 68 having the through holes which are similar to those of the cap protector 67 is accommodated in the recessed portion 60*b*. Therefore, it is possible to restrain the deformation of the cap 60.

Further, since one through hole 71 is communicated with four pieces of the through holes 72, it is possible to guide (lead) the ink flowing from one through hole 71 out through the four through holes 72, thereby making it possible to discharge, at a time, a great amount of the ink received in the recessed portion 60*a* of the cap 60. Here, since the overlapping areas at which the four through holes 72 are overlapped in a plane view with one through hole 71 are same among the four through holes 72, it is possible to guide the ink out through the four through holes 72 in an equal amount.

Further, although it is difficult to form through holes in one cap protector while varying the diameter of each of the through holes at an intermediate portion of the through hole; whereas it is easy to form the through holes to have a same diameter. Therefore, only by stacking the bodies 61 and 62 after forming through holes of different diameters in the bodies 61 and 62 respectively, it is possible to easily form ink flow passages into which the ink is easily made to flow, and in which the capillary force is great.

Next, an explanation will be given about modifications in which the embodiment is modified in various manners. Note that, however, the constitutive parts or components, which are the same as or equivalent to those of the embodiment described above, are designated by the same reference numerals, any explanation of which will be omitted as appropriate.

First Modification

Figure 8:
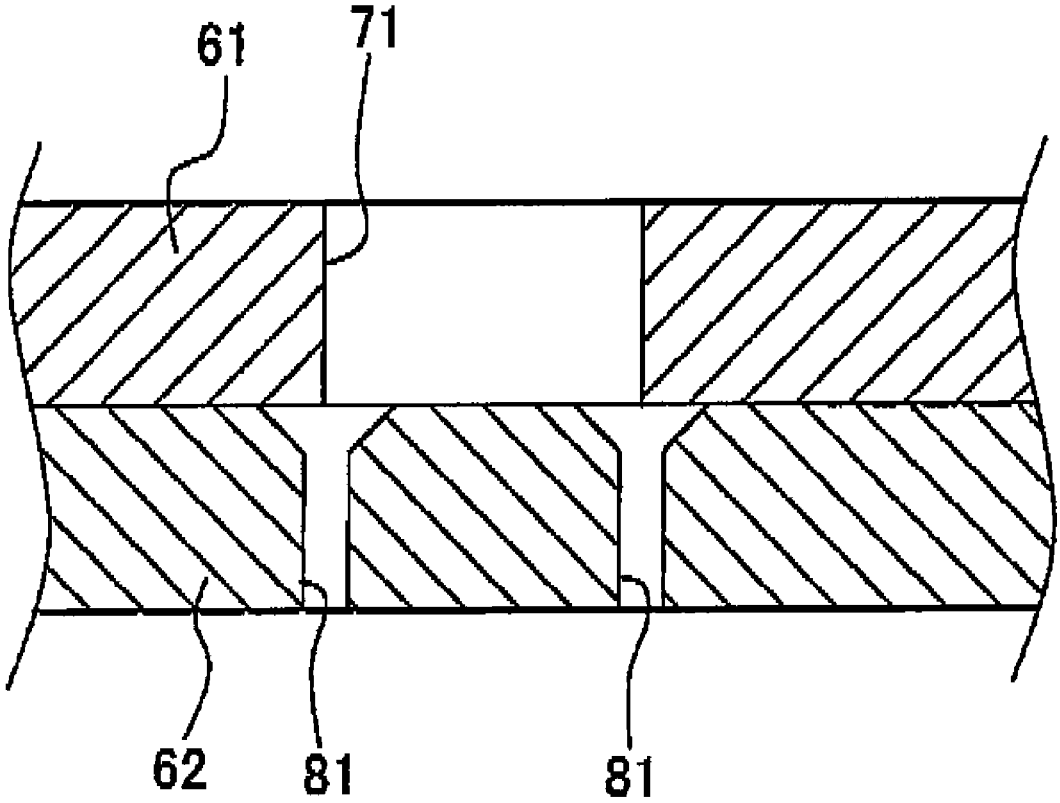
FIG. 8 is a view of a first modification, corresponding to FIG. 6.

As shown in FIG. 8, it is allowable that through holes 81 are formed in the body 62 such that the diameter of the through holes 81 is decreased in a tapered manner in the flowing direction of the ink up to an intermediate portion of the through hole 81, and that the diameter of the through hole 81 is constant through (in) the remaining portion other than the intermediate portion. With this, the opening of each of the through holes 81 is made to be great on the side of the through hole 81 into which the ink is inflowed (ink-in flow side), and thus the ink is easily flowed into the through hole 71. After that, since the ink flowing into the through holes 81 further flows through the flow passage having a small diameter, the capillary force acting on the flowing ink is made to be great.

Second Modification

Figure 9:
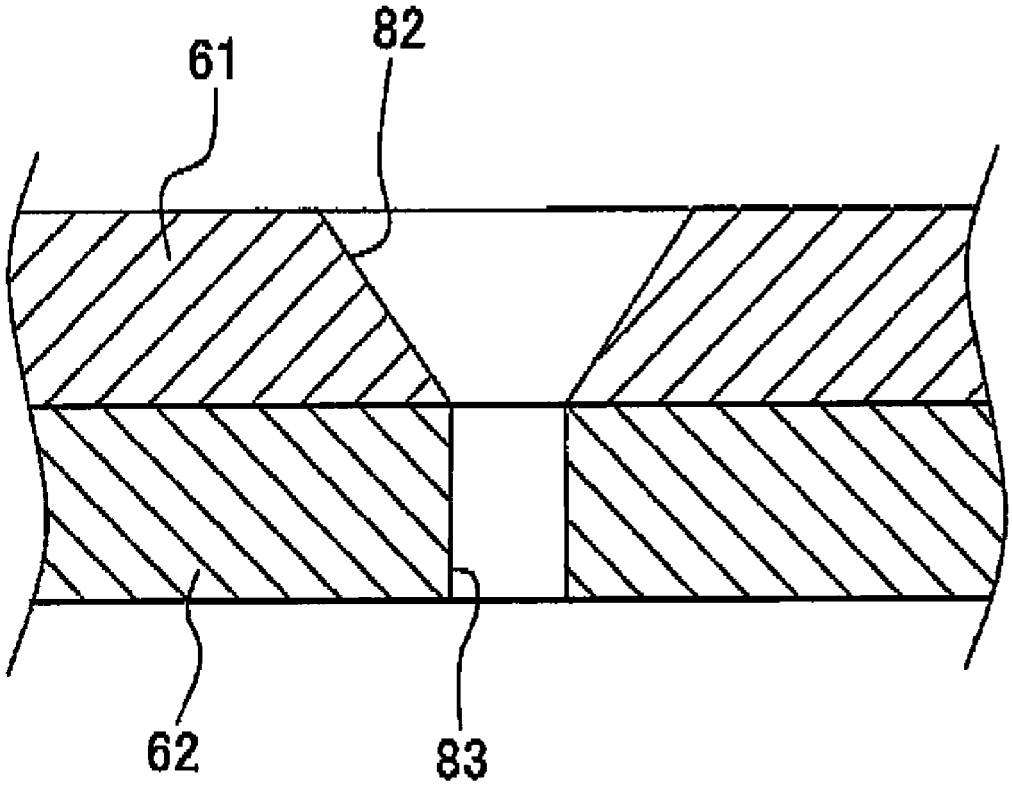
FIG. 9 is a view of a second modification, corresponding to FIG. 6.

Further, as shown in FIG. 9, it is allowable to form, in the body 61, taper-shaped through holes 82 of which diameter is decreased in a tapered manner in the ink flowing direction; and to form, in the body 62, through holes 83 having a same (constant) diameter. In this case, one piece of through holes 82 is communicated with one piece of the through holes 83.

Third Modification

Figure 10:
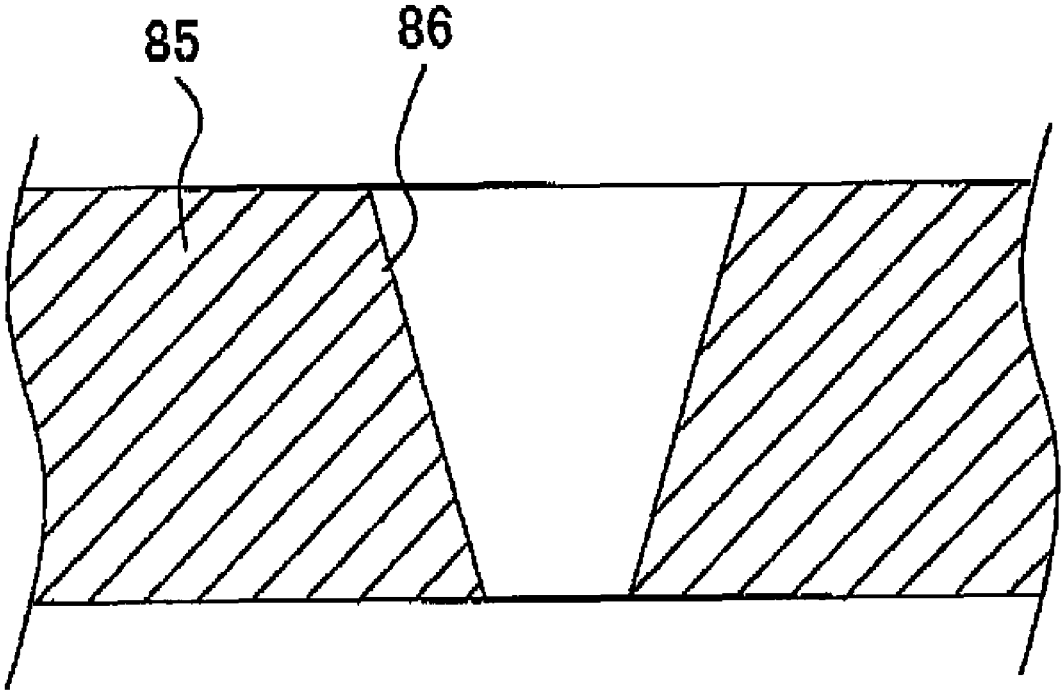
FIG. 10 is a view of a third modification, corresponding to FIG. 6.

As shown in FIG. 10, it is allowable to construct a cap protector, on one body 85 having a thickness same as or similar to the thickness obtained by stacking the bodies 61 and 62, by forming taper-shaped through holes 86 of which diameter is decreased in the tapered manner in the ink flowing direction. Accordingly, the capillary force acting on the ink flowing through the through hole 86 is increased as the ink flows from the opening of the through hole 86 on a lead-in side at which the ink is introduced (led) into the through hole 86 toward the opening of the through hole 86 on a lead-out side at which the ink is guided (led) out of the through hole 86, thereby making it possible to quickly discharge the ink. In short, as shown in FIGS. 8 to 10, it is allowable that an ink flow passage is formed, in the cap protector, such that the ink easily inflows into the ink flow passage and that the capillary force acting on the ink which flows through the ink flow passage is made to be great, by making the opening into which the ink is inflowed is made to be greater than the opening out of which the ink is outflowed.

Further, in the embodiment, one through hole 71 formed in the upper-layer body 61 is communicated with four through holes 72 formed in the lower-layer body 62. However, it is allowable that either one piece or a plurality of pieces of the through holes 72 is/are communicated with one through hole 71. Note that it is preferable that a central axis of the through hole 71 and central axes of the through holes 72 are arranged to be out of alignment.

Further, in the embodiment, the cap protector is constructed by stacking two bodies. However, it is also allowable that the cap protector is constructed by forming through holes in one body, or by forming a plurality of through holes in each of three or more bodies and then stacking the three or more bodies.

The cap protector is not limited to a plate-shaped member, and may be formed to have any shape. Further, it is allowable that the cap protector has a rigidity sufficiently enough to prevent (inhibit, restrain) the deformation of the cap, and the cap protector may be formed of any materials such as metal, ceramics, etc. In a case that a plurality of bodies are stacked, the bodies may be joined together, for example, with an adhesive. Further, it is allowable, regarding two bodies which are to be stacked together, to form a projection in one of the two bodies and to form a recess with which the projection is fittable (engageable) in the other of the two bodies; and to join the two bodies together by engaging (fitting) the projection and the recess with each other. Alternatively, the two bodies may be jointed with any method or manner other than those described above.

In the above-described embodiment, the present invention is applied to the suction cap device 13 provided on a serial printer. However, the present invention may be applied also to a suction cap device provided on a line printer. Further, the present invention is not limited to the application to the ink-jet printers, but is widely applicable to suction cap devices provided on various liquid jetting apparatuses jetting various kinds of liquids onto an jetting object in accordance with the purposes thereof.

What is claimed is:

1. A suction cap device capable of covering a liquid jetting surface, of a liquid jetting head, having a jetting port which is formed in the liquid jetting surface and through which a liquid is jetted, the suction cap device comprising:

a cap member which is formed of an elastic member, which is configured to cover the liquid jetting surface, which is formed to have a recessed portion, and which has a suction port formed in a bottom surface of the cap member to be located inside the recessed portion;

a suction mechanism which communicates with the suction port; and a cap protector which is accommodated in the recessed portion of the cap member, and which prevents, under a condition that the suction mechanism carries out a suction in a state that the liquid jetting surface is covered by the cap member, the cap member from being deformed due to decrease in pressure inside the recessed portion, the cap protector including a body and a liquid flow passage which has a lead-in port formed to penetrate through the body and open on a first surface, of the body, on a side opposite to the suction port and a lead-out port formed to penetrate through the body and open on a second surface, of the body, facing the suction port, and which causes the liquid inside the cap member to flow;

wherein in the liquid flow passage, a diameter of the lead-in port is greater than a diameter of the lead-out port.

2. The suction cap device according to claim 1, wherein the body of the cap protector is formed of a plate-shaped member; and the liquid flow passage is formed to penetrate through the plate-shaped body in a thickness direction of the plate-shaped body.

3. The suction cap device according to claim 1, wherein the cap protector is formed of a material having a rigidity higher than that of the cap member.

4. The suction cap device according to claim 3, wherein the cap protector is formed of a material selected from the group consisting of a resin material, a metallic material and a ceramic material.

5. The suction cap device according to claim 1, wherein the cap protector has a shape which is approximately same, in a plane view, as a shape of the recessed portion of the cap member.

6. The suction cap device according to claim 1, wherein an outer diameter of the lead-out port has a dimension with which a capillary force acts on the liquid in the liquid flow passage.

7. The suction cap device according to claim 2, wherein a diameter of the liquid flow passage is decreased from the lead-in port toward the lead-out port.

8. The suction cap device according to claim 2, wherein the lead-out port is formed as a plurality of lead-out ports on the second surface of the body; and one piece of the lead-in port is communicated with lead-out ports among the plurality of lead-out ports.

9. The suction cap device according to claim 8, wherein central axes of the lead-out ports and a central axis of the lead-in port are arranged to be out of alignment with each other.

10. The suction cap device according to claim 8, wherein the lead-out ports are formed in the body to be equally spaced apart in a planar direction of the body; overlapping areas, of the lead-in port, at which the lead-in port overlaps in a plane view with the lead-out ports respectively, are same with each other.

11. The suction cap device according to claim 8, wherein the body of the cap protector has a plurality of plate-shaped members which are stacked on each other.

12. The suction cap device according to claim 11, wherein the liquid flow passage is formed in each of the plate-shaped members; the liquid flow passage formed in a plate-shaped member, among the plurality of plate-shaped members, which is stacked as a lower layer, is arranged in a staggered form in a plane view with respect to the liquid flow passage formed in another plate-shaped member among the plurality of plate-shaped members as an upper layer.

13. The suction cap device according to claim 11, wherein a through hole forming the liquid flow passage is formed in the plate-shaped member stacked as the lower layer; an opening of the through hole on an upper surface of the plate-shaped member stacked as the lower layer has a diameter greater than a diameter of an opening of the through hole on a lower surface of the plate-shaped member stacked as the lower layer.

14. The suction cap device according to claim 1, wherein two recessed portions are formed in the cap member, the cap protector is formed as two cap protectors corresponding to the two recessed portions, respectively, and a flow conductance of the liquid flow passage formed in one of the two cap protectors is different from a flow conductance of the liquid flow passage formed in the other of the two cap protectors.

15. A liquid jetting apparatus which jets a liquid onto an object, the apparatus comprising: a liquid jetting head having a liquid jetting surface having a jetting port which is formed in the liquid jetting surface and through which the liquid is jetted; the suction cap device as defined in claim 1 which is configured to cover the liquid jetting surface; a liquid tank which supplies the liquid to the liquid jetting head; and a transport mechanism which transports the object toward the liquid jetting head.

16. The suction cap device according to claim 11, wherein the lead-in ports and the lead-out ports are formed in one of the plate-shaped members and another if the plate-shaped members, respectively, such that $$p1=p2$$

$$\sqrt{2} * p1-d2 < d < p1$$

wherein p1=a distance between two adjacent lead-in ports, p2=a distance between two lead-out ports, d1=a diameter of the lead-in ports, and d2=a diameter of the lead-out ports.

* * * * *